US011220102B2

(12) United States Patent
Chungbin et al.

(10) Patent No.: US 11,220,102 B2
(45) Date of Patent: Jan. 11, 2022

(54) VENTURI INLET PRINTHEAD

(71) Applicant: XEROX CORPORATION, Norwalk, CT (US)

(72) Inventors: Christopher T. Chungbin, Webster, NY (US); Kareem N. Tawil, Pittsford, NY (US); Zachary S. Vader, East Amherst, NY (US)

(73) Assignee: XEROX CORPORATION, Norwalk, CT (US)

( * ) Notice: Subject to any disclaimer, the term of this patent is extended or adjusted under 35 U.S.C. 154(b) by 145 days.

(21) Appl. No.: 16/712,725

(22) Filed: Dec. 12, 2019

(65) Prior Publication Data

US 2021/0178751 A1 Jun. 17, 2021

(51) Int. Cl.

| | |
|---|---|
| ***B41J 2/14*** | (2006.01) |
| ***B41J 2/03*** | (2006.01) |
| ***B41J 2/16*** | (2006.01) |
| ***B41J 2/045*** | (2006.01) |
| ***B41J 2/175*** | (2006.01) |
| ***B41J 2/05*** | (2006.01) |

(52) U.S. Cl.

CPC ..... *B41J 2/03* (2013.01); *B41J 2/0456* (2013.01); *B41J 2/05* (2013.01); *B41J 2/16* (2013.01); *B41J 2/175* (2013.01)

(58) Field of Classification Search

CPC ..... B41J 2/14; B41J 2/14032; B41J 2/1404; B41J 2/14201; B41J 2/1433; B41J 2002/14475

See application file for complete search history.

(56) References Cited

U.S. PATENT DOCUMENTS 8,888,250 B2 11/2014 Law et al.
9,616,494 B2 4/2017 Vader et al.
(Continued)

FOREIGN PATENT DOCUMENTS

WO 2004/091911 A2 10/2004

OTHER PUBLICATIONS

Sukhotskiy et al., "Magnetohydrodynamic Drop-on-Demand Liquid Metal 3D Printing," Solid Freeform Fabrication 2017: Proceedings of the 28th Annual International Solid Freeform Fabrication Symposium—An Additive Manufacturing Conference, pp. 1806-1811.
(Continued)

*Primary Examiner* — Scott A Richmond
(74) *Attorney, Agent, or Firm* — MH2 Technology Law Group LLP

(57) ABSTRACT

A jetting assembly for ejecting a print material includes an actuator for applying a pressure to the print material, and further includes jetting assembly block that defines a pump chamber, a converging part (i.e., a narrowing taper), and a nozzle bore that ends or terminates in a nozzle from which a drop of the print material is ejected. An implementation can further include a throat and a diverging part that, together with the converging part, forms a venturi. The converging part results in an increase in a velocity of the print material and a decrease in pressure as the print material passes an supply port of a supply channel. The decrease in pressure can result in a replacement of at least a portion of the drop volume within the throat or the nozzle bore even before the drop is ejected from the nozzle.

18 Claims, 3 Drawing Sheets

(56) References Cited

U.S. PATENT DOCUMENTS

| | | | | |
|---|---|---|---|---|
| 10,040,119 | B2 | 8/2018 | Vader et al. | |
| 2020/0079087 | A1* | 3/2020 | Ishihara | B41J 2/1433 |
| 2020/0290350 | A1* | 9/2020 | Budraa | B41J 2/1433 |

OTHER PUBLICATIONS

Karampelas et al., "Drop-on-Demand 3D Metal Printing," Informatics, Electronics and Microsystems: TechConnect Briefs, 2017, pp. 153-155.

* cited by examiner

VENTURI INLET PRINTHEAD

TECHNICAL FIELD

The present teachings relate to the field of printing and, more particularly, to a jetting design and assembly for ejecting a print material from a nozzle or aperture.

BACKGROUND

Drop-on-demand and continuous ink jet printing are used during text and image printing, three dimensional (3D) printing, functional printing, binder jetting, and other printing. Typical jetting techniques include piezoelectric ink jet, thermal ink jet, and gas expansion jetting. These conventional technologies have a maximum drop ejection frequency that is limited, at least in part, by time required to replace the ejected print material within the printhead structure in preparation for ejecting the next drop. While there are many different flow path channel designs for routing the print material through the printhead and many actuator designs for ejecting the print material, most designs have a narrow or restricted channel through which the print material flows from a print material reservoir to a nozzle bore that ends in a nozzle from which the print material is ejected. This restricted channel, in part, reduces or prevents a backflow of the print material back through the restricted channel toward the print material reservoir when the actuator is fired to eject the drop of print material from the nozzle. However, this narrow channel can slow the refill of the nozzle bore from the reservoir through the narrow channel, which is necessary to replace the volume of ejected print material. Currently, the time required to refill the print material is improved by optimizing the flow path restriction, carefully controlling a waveform of a driving pressure used to eject the print material, and consideration of printhead acoustics.

A printhead design and method for printing using the printhead design that improves the flow and speed of print material through the printhead during printing would increase printing speed and would be a welcome addition to the art.

SUMMARY

The following presents a simplified summary in order to provide a basic understanding of some aspects of one or more implementations of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an implementation of the present teachings, a jetting assembly for ejecting a print material includes a jetting assembly block, wherein the jetting assembly block defines a pump chamber, a converging part having a first end with a first width and a second end with a second width, wherein the first width is wider than the second width, and a nozzle bore terminating in a nozzle from which a print material is ejected. In this implementation, the converging part is positioned between the pump chamber and the nozzle bore, the first end of the converging part is proximate the pump chamber, the second end of the converging part is proximate the nozzle bore, and the pump chamber, the converging part, and the nozzle bore are in fluid communication, each with the other. The jetting assembly further includes an actuator configured to apply a pressure to a print material within the pump chamber.

Optionally, the jetting assembly further includes a diverging part having a third end with a third width and a fourth end having a fourth width, wherein the third width is narrower than the fourth width, the diverging part is positioned between the converging part and the nozzle bore, the third end is proximate the converging part, the fourth end is proximate the nozzle bore, the diverging part is in fluid communication with the pump chamber, the converging part, and the nozzle bore, and the converging part and the diverging part define, at least in part, a venturi. The venturi can further include a throat positioned between, and in fluid communication with, the converging part and the diverging part, and the radial centers of the pump chamber, the converging part, the throat, the diverging part, the nozzle bore, and the nozzle can be aligned along an axis. Optionally, the jetting assembly block further defines a supply channel that ends in a supply port, wherein the supply channel opens into the throat of the venturi at the supply port. The jetting assembly block can further define a supply channel that ends in a supply port, wherein the supply channel opens into the nozzle bore. In an implementation, radial centers of the pump chamber, the converging part, the nozzle bore, and the nozzle can be aligned along an axis. In an optional implementation, the jetting assembly further includes a print material within the pump chamber, the converging part, and the nozzle bore.

In another implementation, a printer includes a jetting assembly for ejecting a print material, the jetting assembly including a jetting assembly block, wherein the jetting assembly block defines a pump chamber, a converging part having a first end with a first width and a second end with a second width, wherein the first width is wider than the second width, and a nozzle bore terminating in a nozzle from which a print material is ejected. In this implementation, the converging part is positioned between the pump chamber and the nozzle bore, the first end of the converging part is proximate the pump chamber, the second end of the converging part is proximate the nozzle bore, and the pump chamber, the converging part, and the nozzle bore are in fluid communication, each with the other. The printer further includes an actuator configured to apply a pressure to a print material within the pump chamber and a housing that encases the jetting assembly.

Optionally, the printer further includes a diverging part having a third end with a third width and a fourth end having a fourth width, wherein the third width is narrower than the fourth width, the diverging part is positioned between the converging part and the nozzle bore, the third end is proximate the converging part, the fourth end is proximate the nozzle bore, the diverging part is in fluid communication with the pump chamber, the converging part, and the nozzle bore, and the converging part and the diverging part define, at least in part, a venturi. The venturi further optionally includes a throat positioned between, and in fluid communication with, the converging part and the diverging part. Moreover, radial centers of the pump chamber, the converging part, the throat, the diverging part, the nozzle bore, and the nozzle can be aligned along an axis, and the jetting assembly block can further define a supply channel that ends in a supply port, wherein the supply channel opens into the throat of the venturi at the supply port. In another implementation, the jetting assembly block can further define a supply channel that ends in a supply port, wherein the supply channel opens into the nozzle bore, and radial centers of the pump chamber, the converging part, the nozzle bore, and the nozzle can be aligned along an axis. In an implementation, the printer further includes a print material within the pump chamber, the converging part, and the nozzle bore.

In another implementation, a method for printing includes firing an actuator to apply a pressure to a print material within a pump chamber, increasing a velocity of the print material within the pump chamber responsive to the firing of the actuator, flowing the print material from the pump chamber into first end of a converging part, through the converging part, and to a second end of the converging part responsive to the firing of the actuator, wherein the first end has a first width, the second end has a second width, and the first width is wider than the second end, flowing the print material from the second end of the converging part into a nozzle bore, and flowing the print material from the nozzle bore to the nozzle, responsive to the firing of the actuator, and ejecting a drop of the print material from the nozzle responsive to the firing of the actuator.

Optionally, the method can further include flowing the print material from the second end of the converging part to a throat, then flowing the print material from the throat to a third end of a diverging part, through the diverging part, and to a fourth end of the diverging part. In this implementation, the third end of the diverging part has a third width, the fourth end of the diverging part has a fourth width, the third width is narrower than the fourth width, and the converging part, the throat, and the diverging part define, at least in part, a venturi. The method further optionally includes performing the flowing of the print material into the nozzle bore. The method can further include increasing a velocity of the print material as the print material passes through the throat, decreasing a pressure of the print material within the throat responsive to the increasing of the velocity, and resupplying at least a portion of a volume of the printed drop from a supply channel, through a supply port, and into the throat responsive to the decreasing of the pressure of the print material within the throat. Subsequently, the method preforms the ejecting of the drop of the print material from the nozzle after performing the resupplying.

Further optionally, the method can include increasing a velocity of the print material as the print material passes through the nozzle bore, decreasing a pressure of the print material within the nozzle bore responsive to the increasing of the velocity, and resupplying at least a portion of a volume of the printed drop from a supply channel, through a supply port, and into the nozzle bore responsive to the decreasing of the pressure of the print material within the nozzle bore. The method then performs the ejecting of the drop of the print material from the nozzle after performing the resupplying. The method can also include decreasing a pressure at a supply inlet responsive to the flowing of the print material through the converging part and from the second end of the converging part into the nozzle bore and flowing the print material from a supply channel through the supply inlet responsive to the decreasing of the pressure at the supply inlet, thereby replacing at least a portion of a volume of the drop of the print material, wherein the replacing of the portion of the drop volume occurs after the firing of the actuator and before the ejecting of the drop of the print material from the nozzle.

BRIEF DESCRIPTION OF THE DRAWINGS

The accompanying drawings, which are incorporated in, and constitute a part of this specification, illustrate implementations of the present teachings and, together with the description, serve to explain the principles of the disclosure. In the figures.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary implementations of the present teachings, examples of which are illustrated in the accompanying drawings. Generally and/or where convenient, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, 3D printing (also referred to herein as "additive manufacturing"), etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

As discussed above, jetting speed or drop ejection frequency is limited, at least in part, by the speed at which the ejected print material 102 can be replaced. Some current printhead designs include the use of a channel having a generally uniform width between the actuator and the nozzle from which a drop is ejected. (For purposes of the present teachings, unless otherwise specified, a width of a channel is measured perpendicular to the flow of print material through the channel.) Replacement of the print material 102 ejected during printing typically includes the flow of the print material through a supply inlet into the channel. A width or diameter of the supply inlet is designed to be sufficiently narrow to reduce or prevent a backflow of the print material from the channel into the supply inlet during ejection of the drop from the nozzle. However, as a tradeoff, forming a supply inlet with a narrow width decreases a flow rate of the print material through the supply inlet into the channel. This decreases the rate at which the printed print material can be replaced which, in turn, reduces the frequency at which the print material can be ejected from the nozzle.

An implementation of the present teachings can increase the replacement rate of print material within the nozzle bore, thereby increasing the speed or frequency at which the print material can be ejected from the nozzle.

Figure 1:
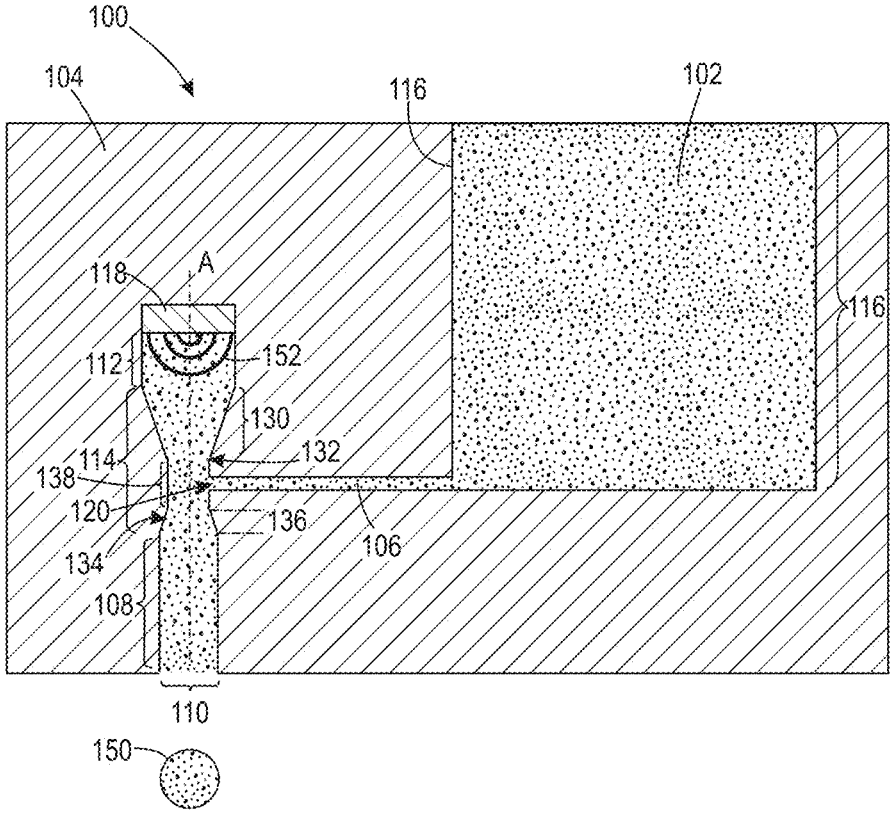
FIG. 1 is a schematic cross sectional depiction of a jetting assembly according to an implementation of the present teachings.

FIG. 1 is a schematic cross section of a portion of a jetting assembly 100 for ejecting a print material (e.g., a print fluid) 102 in accordance with an implementation of the present teachings. The jetting assembly 100 may be a subassembly of a printhead and/or a printer. The jetting assembly 100 includes a jetting assembly block 104 that defines a plurality of channels where, in this example implementation, the plurality of channels includes at least one supply channel 106, a nozzle bore 108 that ends or terminates in an aperture or nozzle 110 from which a drop 150 of the print material 102 is ejected during use, a pump channel (i.e., pump chamber) 112, and a venturi 114 positioned between, and continuous with, the pump chamber 112 and the nozzle bore 108. The jetting assembly 100 further includes a reservoir 116 that stores a supply of the print material 102, and an actuator 118 that is configured to eject the drop 150 from the nozzle 110 when the actuator 118 is actuated (i.e., activated or "fired").

In the example implementation of FIG. 1, the supply channel 106 ends or terminates in a supply inlet or supply port 120 such that print material 102 from the supply channel 106 exits the supply port 120 into the venturi 114. The reservoir 116, the supply channel 106, the pump chamber 112, the venturi 114, the nozzle bore 108, and the nozzle 110 are in fluid communication, each with the other. Moreover, the actuator 118 is positioned at a first end of the pump chamber 112, while the venturi is positioned at a second end of the pump chamber 112, where the second end is opposite the first end. While FIG. 1 depicts the block 104 as a solid block of material, it will be appreciated that the block 104 can be assembled from two or more separate pieces or sections to simplify manufacture.

Depending on the properties of the print material 102, the actuator 118 can be a piezoelectric actuator, a heating device which creates or expands a gas bubble, a magnetohydrodynamic actuator, or another type of actuator. The print material 102 can be or include, for example, an aqueous ink or a non-aqueous ink (each of which includes a solvent and a pigment), a molten metal, a molten metal alloy a polymer-based ink or a polymer-based resin (e.g., an ultraviolet-cured polymers), a glass, a ceramic, a binder as applied during binder jetting, or reactants which form a ceramic or a polymer (i.e., a ceramic precursor or a polymer precursor). It will be appreciated that, in some implementations, the jetting assembly 100 will not include the print material 102, for example, during and immediately after manufacture, and prior to use. In other implementations, the jetting assembly 100 will include the print material 102. Additionally, the implementations depicted and described herein are intended to be non-limiting examples. A jetting assembly in accordance with the present teachings can include other structures and/or features that have not been depicted for simplicity, while various depicted structures and/or features can be removed or modified.

Simulations of jetting assemblies in accordance with the present teachings that include a venturi 114 as depicted and described herein have been found to result in a more rapid replacement of the print material 102 ejected as one or more drops 150 compared to conventional jetting assemblies, as described below.

To print a drop 150 of the print material 102, the actuator 118 is fired which creates a pressure 152 on and within the print material 102 that is inside the pump chamber 112. The print material 102 has a first velocity within the pump chamber 112, where the first velocity is dependent on various factors such as the force exerted on the print material 102 by the actuator 118, a viscosity of the print material 102, and sizes of the pump chamber 112 and other connected channels. The firing of the actuator 118 initiates a flow of the print material 102 within the pump chamber 112 in a direction away from the actuator 118 and toward the nozzle 110. As the print material 102 enters the venturi 114 from the pump chamber 112, a converging part (i.e., a narrowing taper) 130 of the venturi 114 causes the flow of the print material 102 to increase in speed through the converging part 130 to a second velocity at a first boundary 132 between the converging part 130 and a throat 138 of the venturi 114. This first boundary 132 is the narrowest extent of the converging part 130, and the second velocity is greater than the first velocity. From the first boundary 132, which is also the beginning of the throat 138, to a second boundary 134 between the throat 138 and a diverging part (i.e., a widening taper) 136 of the venturi 114, the throat 138 of the venturi 114 maintains a constant width. The second boundary 134 of the throat 138 and the diverging part 136 is also the end of the throat 138. Further, radial centers of the pump chamber 112, the venturi 114 (including the converging part 130, the throat 138, and the diverging part 136), the nozzle bore 108, and the nozzle 110 are generally aligned along an axis A. In this implementation, print material 102 flows through the venturi 114 from the converging part 130, through the throat 138 that is connected to the converging part 130, through the diverging part 136 that is connected to the throat 138, and then to the nozzle bore 108 which is connected to the diverging part 136.

As depicted, supply channel 106 opens into the throat 138 of the venturi 114 at the supply port 120, where the supply port 120 is positioned between the first boundary 132 and the second boundary 134. As the flow of the print material 102 enters the diverging part 136 from the throat 138, the diverging part 136 causes the flow to decrease in speed to a third velocity that is slower than the second velocity, at which point the flow enters the nozzle bore 108. The pressure 152 then travels through a length of the nozzle bore 108, where it causes the drop 150 of the print material 102 to be ejected from the nozzle 110.

The venturi 114 between the pump chamber 112 and the nozzle bore 108, and the increased velocity of the print material 102 through the venturi 114, results in a decreased pressure within the throat 138 and at the supply port 120 after the firing of the actuator 118 and during the ejection of the drop 150 from the nozzle 110. This decreased pressure at the supply port 120 causes the print material 102 from the supply channel 106 to flow into the throat 138 of the venturi 114 through the supply port 120 when the print material 102 flows past the supply port 120 until the drop 150 is ejected from the nozzle 110. Thus the inflow of the print material 102 from the supply channel 106 to the throat 138 of the venturi 114 to replace the ejected print material 102 begins after the actuator 120 is fired and before the ejection of the drop 150 from the nozzle 110, such that at least a portion of the drop volume is replaced before the drop 150 is ejected from the nozzle 110. In contrast, with some prior jetting assembly designs, replacement of the ejected print material does not begin until after the drop has been ejected. A jetting assembly design according to the present teachings begins the replacement of the print material sooner than conventional designs, before the drop that is being replaced has been printed. Thus the drop ejection frequency of the jetting assembly according to the present teachings can be higher than some current jetting assembly designs, even using the same actuator.

The jetting assembly 100 design of FIG. 1 includes a complete venturi where, with reference to the orientation of FIG. 1, the venturi 114 includes the converging part 130 at and within an upper extent, a constant width at and within the throat 138 at a middle section, and the diverging part 136 at and within a lower extent. Before ejecting the drop 150 of print material 102, the actuator 118 fires and generates the pressure 152 on the print material 102. In particular, the pressure 152 initiates the flow of the print material 102 from and through the pump chamber 112, to and through the converging part 130, to and through the throat 138, to and through the diverging part 136, to and through the nozzle bore 108 to the nozzle 110, thereby resulting in ejection of the drop 150 from the nozzle 110. As the flow of the print material 102 passes through the throat 138, the velocity of the print material 102 within the throat 138 increases, pressure of the print material 102 within the throat 138 decreases, and the print material 102 flows into the throat 138 through the supply port 120 from the supply channel 106 responsive to the decreasing pressure of the print material 102 within the throat 138.

Figure 2:
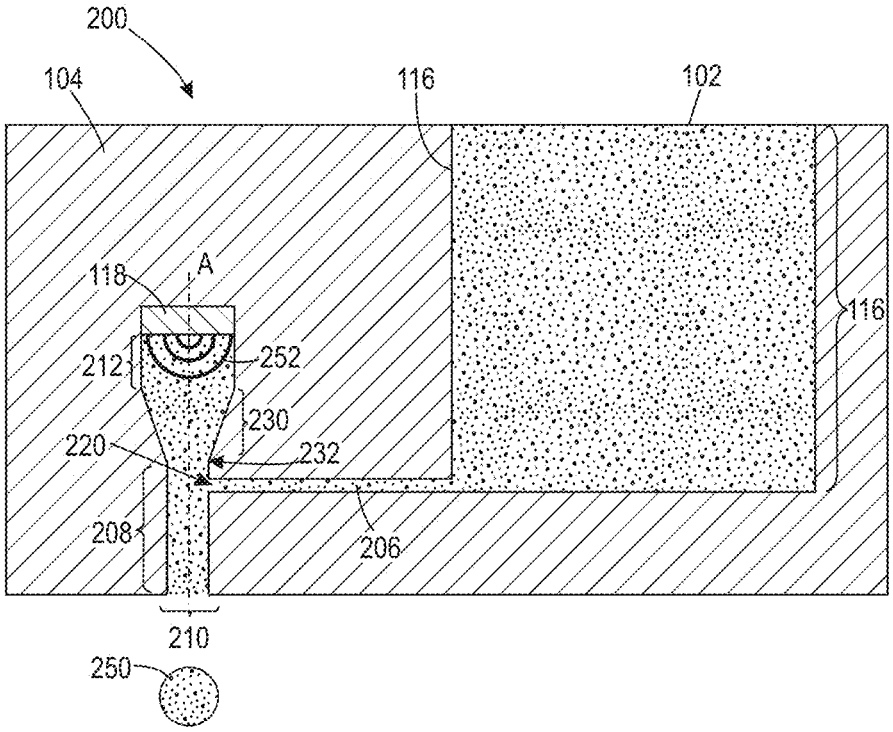
FIG. 2 is a schematic cross sectional depiction of a jetting assembly according to another implementation of the present teachings.

FIG. 2 depicts a jetting assembly 200 according to another implementation of the present teachings. The jetting assembly of FIG. 2 includes a jetting assembly block 204, that defines a plurality of channels where, in this implementation, the plurality of channels includes at least one supply channel 206, a nozzle bore 208 that ends or terminates in an aperture or nozzle 210 from which a drop 250 of the print material 102 is ejected during use, a pump chamber 212, and a converging part 230 positioned between, and continuous with, the pump chamber 212 and the nozzle bore 208. The jetting assembly 200 further includes a reservoir 116 that stores a supply of the print material 102, and an actuator 118 that is configured to eject the drop 250 from the nozzle 210 when the actuator 118 is actuated or fired.

In the example implementation of FIG. 2, the supply channel 206 ends or terminates in a supply port 220 such that print material 102 from the supply channel 206 exits the supply port 220 into the nozzle bore 208. Further, radial centers of the pump chamber 212, the converging part 230, the nozzle bore 208, and the nozzle 210 are generally aligned along an axis A. Additionally, the reservoir 116, the supply channel 206, the pump chamber 212, the converging part 230, the nozzle bore 208, and the nozzle 210 are in fluid communication, each with the other. Moreover, the actuator 118 is positioned at a first end of the pump chamber 212, while the converging part 230 is positioned at a second end of the pump chamber 212, where the second end is opposite the first end. While FIG. 2 depicts the block 204 as a solid block of material, it will be appreciated that the block 204 can be assembled from two or more separate pieces or sections to simplify manufacture.

Simulations of jetting assemblies in accordance with the present teachings that include a converging part 230 as depicted and described herein have been found to result in a more rapid replacement of the print material 102 ejected as one or more drops 250 compared to conventional jetting assemblies, as described below.

To print a drop 250 of the print material 102, the actuator 118 is fired which creates an increased pressure 252 on and within the print material 102 that is inside the pump chamber 212. The pressure 252 causes the print material 102 to have a first velocity within the pump chamber 212, where the first velocity is dependent on various factors such as the force exerted on the print material 102 by the actuator 118, a viscosity of the print material 102, and sizes of the pump chamber 212 and other connected channels. The firing of the actuator 118 initiates a flow of the print material 102 within the pump chamber 212 in a direction away from the actuator 118 and toward the nozzle 210. As the flow of the print material 102 enters the converging part 230 from the pump chamber 112, the converging part 230 causes the flow of the print material 102 to increase in speed through the converging part 230 to a second velocity at a boundary 232 of the converging part 230, where boundary 232 is the narrowest extent of the converging part 230 and the second velocity is greater than the first velocity. In this implementation, the converging part 230 ends, and the nozzle bore 208 begins, at the boundary 232. From the boundary 232 to the nozzle 210, the nozzle bore 208 maintains a constant width, and thus print material 102 generally maintains the second velocity as it passes from the boundary 232 through the nozzle bore 208 to the nozzle 210. As depicted, supply channel 106 opens into the nozzle bore 208 at the supply port 220, where the supply port 220 is positioned between the boundary 232 and the nozzle 210. As the print material 102 flows through a length of the nozzle bore 108 to the nozzle 210, the flow causes the drop 250 of the print material 102 to be ejected from the nozzle 210.

The converging part 230 between the pump chamber 212 and the nozzle bore 208, and the increased velocity of the print material 102 through the converging part 230 and the nozzle bore 208, results in a decreased pressure at the supply port 220 after the firing of the actuator 118 and during the ejection of the drop 250 from the nozzle 210. This decreased pressure at the supply port 220 causes the print material 102 from the supply channel 206 to flow into the nozzle bore 208 through the supply port 220 when print material 102 flows past the supply port 220 until the drop 250 is ejected from the nozzle 210. Thus the inflow of the print material 102 from the supply channel 106 to the nozzle bore 208 to replace the ejected print material 102 begins even before the ejection of the drop 250 from the nozzle 210. In contrast, with some prior jetting assembly designs, replacement of the ejected print material does not begin until after the print material has been ejected. A jetting assembly design according to the present teachings begins the replacement of the print material even before the drop of print material has been ejected. Thus the drop ejection frequency of the jetting assembly according to the present teachings can be higher than some current jetting assembly designs, even using the same actuator.

The jetting assembly 200 design of FIG. 2 the pump chamber 212, the converging part 230, the nozzle bore 208, and the nozzle 210. Before ejecting the drop 250 of print material 102, the actuator 118 fires and generates the pressure 252 on the print material 102. In particular, the pressure 252 initiates the flow of the print material 102 from and through the pump chamber 212, to and through the converging part 230, to and through the nozzle bore 208 to the nozzle 210, thereby resulting in ejection of the drop 250 from the nozzle 210. As the print material 102 passes through the nozzle bore 208, the velocity of the print material 102 within the nozzle bore 208 increases, pressure of the print material 102 within the nozzle bore 208 decreases responsive to the increasing velocity, and print material 102 flows through the supply port 220 from the supply channel 206 into the nozzle bore 208 responsive to the decreasing pressure of the print material 102 within the nozzle bore 208.

In FIG. 1, the jetting assembly 100 includes a converging part 130 in fluid communication with the pump chamber 112, the nozzle bore 108, the nozzle 110, the supply port 120, and the supply channel 106. In FIG. 2, the jetting assembly 200 includes a converging part 230 in fluid communication with the pump chamber 212, the nozzle bore 208, the nozzle 210, the supply port 220, and the supply channel 206.

With the implementations of the present teachings, the actuator applies pressure to the print material across a relatively large horizontal surface area (with reference to the orientation of FIGS. 1 and 2). Within the pump chamber, the print material has a relatively slow flow speed. The horizontal surface area tapers within the converging part 130, 230 to a smaller horizontal surface area. The converging part causes the print material to accelerate, which reduces the pressure through the venturi effect. Depending on the reduction in horizontal surface area within the converging part, the pressure can be reduced below the ambient pressure such that the print material 102 is pulled through the supply port 120, 220 into the venturi 114 and/or the nozzle bore 108, 208, even during the ejection of the drop 150, 250. Simulations on an implementation of the present teachings suggest the pressure at the supply port increases and decreases for a period of time during and after the actuator 118 is fired. The increase in pressure results in a short period of backflow through the supply port 120, 220 and into the supply channel 106, 206 as the venturi flow is established within the converging part 130, 230. The relatively short increase in pressure at the supply port 120 is followed by a much longer decrease in pressure at the supply port 120, 220. The decrease in pressure results in a longer period of inflow of print material 102 through the supply port 120, 220 and into the venturi 114 and/or nozzle bore 108, 208 as the drop 150, 250 forms. After the drop 150, 250 is ejected, a meniscus forms at the nozzle during a pull-back of the actuator 118 (i.e., as the actuator 118 relaxes. During the pull-back of the actuator, the inward flow through the supply port 120, 220 continues. This design allows for a large portion of the drop volume to originate from the supply channel 106, 206 rather than from the volume of print material 102 that is displaced by the actuator 118. With current designs, a large portion of the drop volume originates from the volume of print material that is displaced by the actuator rather than from the supply channel 106, 206. The jetting assembly according to the present teachings allows for replacement of the drop volume to begin even before the drop is ejected from the nozzle 110, 210. In contrast, with conventional designs, the drop volume can be replaced only after the drop has been ejected from the nozzle. Thus a jetting assembly of the present teachings can eject drops at a faster rate and a higher frequency than can conventional designs.

While the figures depict a jetting assembly 100, 200 including a single nozzle bore 108, 208 terminating in a single nozzle 110, 210, a jetting assembly including a plurality of nozzle bores 108, 208 and nozzles 110, 210 arranged in a single row, a grid, an array, etc., is contemplated. Such an array could have a high density of nozzles 110 and thus a high deposition rate and a good resolution.

Figure 3:
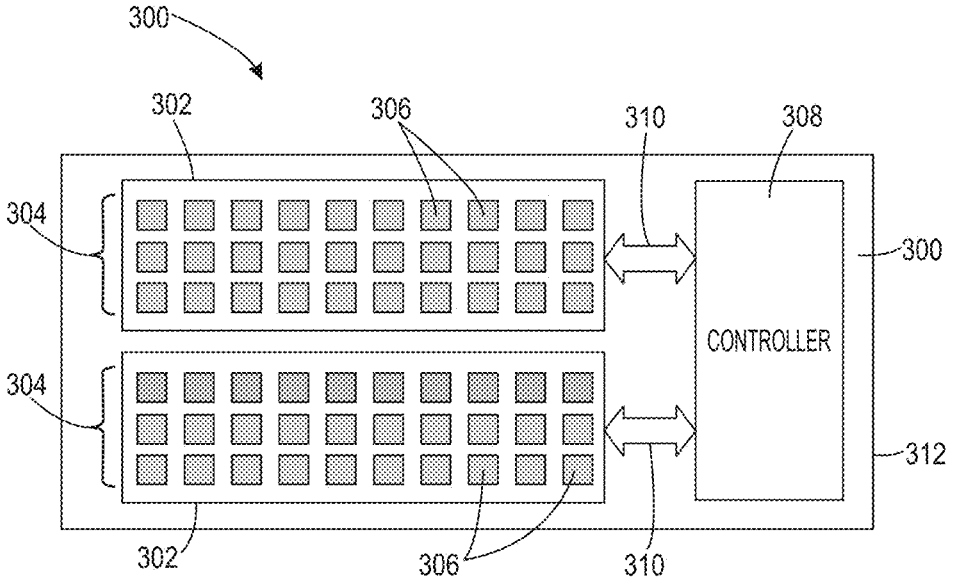
FIG. 3 is a schematic block diagram of a printer having one or more jetting assemblies in accordance with an implementation of the present teachings.

FIG. 3 is a block diagram depicting a printer 300 in accordance with an implementation of the present teachings. The printer 300 includes a plurality of printheads 302, where each printhead 302 includes a jetting assembly array 304 having a plurality of jetting assemblies 306. Each jetting assembly 306 of the plurality of jetting assemblies 306 can be or include a jetting assembly 100, 200 as described above with reference to FIGS. 1 and 2, or another jetting assembly in accordance with the present teachings. The printer 300 further includes a controller 308 that is configured to communicate with the printheads 302 across one or more data buses 310. Additionally, the controller 308 can be configured to control other printing operations such as printer self-checks, cleaning operations, temperature monitoring and control of the printheads 302 and the print material 102 within the printheads 302, etc. The printheads 302 and controller 308 can be at least partially encased within an external housing 312.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or implementations of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated implementation. Finally, "exemplary" indicates the description is used as an example, rather than implying that it is an ideal. Other implementations of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A jetting assembly for ejecting a print material, comprising:

a jetting assembly block, wherein the jetting assembly block defines:

a pump chamber;

a converging part having a first end with a first width and a second end with a second width, wherein the first width is wider than the second width; and a nozzle bore terminating in a nozzle from which a print material is ejected, wherein:

the converging part is positioned between the pump chamber and the nozzle bore;

the first end of the converging part is proximate the pump chamber;

the second end of the converging part is proximate the nozzle bore; and the pump chamber, the converging part, and the nozzle bore are in fluid communication, each with the other;

a diverging part having a third end with a third width and a fourth end having a fourth width, wherein:

the third width is narrower than the fourth width;

the diverging part is positioned between the converging part and the nozzle bore;

the third end is proximate the converging part;

the fourth end is proximate the nozzle bore;

the diverging part is in fluid communication with the pump chamber, the converging part, and the nozzle bore; and the converging part and the diverging part define, at least in part, a venturi; and an actuator configured to apply a pressure to a print material within the pump chamber.

2. The jetting assembly of claim 1, wherein the venturi further comprises a throat positioned between, and in fluid communication with, the converging part and the diverging part.

3. The jetting assembly of claim 2, wherein radial centers of the pump chamber, the converging part, the throat, the diverging part, the nozzle bore, and the nozzle are aligned along an axis.

4. The jetting assembly of claim 2, wherein the jetting assembly block further defines a supply channel that ends in a supply port, wherein the supply channel opens into the throat of the venturi at the supply port.

5. The jetting assembly of claim 1, wherein the jetting assembly block further defines a supply channel that ends in a supply port, wherein the supply channel opens into the nozzle bore.

6. The jetting assembly of claim 1, wherein radial centers of the pump chamber, the converging part, the nozzle bore, and the nozzle are aligned along an axis.

7. The jetting assembly of claim 1, further comprising a print material within the pump chamber, the converging part, and the nozzle bore.

8. A printer, comprising:

a jetting assembly for ejecting a print material, the jetting assembly comprising a jetting assembly block, wherein the jetting assembly block defines:

a pump chamber;

a converging part having a first end with a first width and a second end with a second width, wherein the first width is wider than the second width; and a nozzle bore terminating in a nozzle from which a print material is ejected, wherein:

the converging part is positioned between the pump chamber and the nozzle bore;

the first end of the converging part is proximate the pump chamber;

the second end of the converging part is proximate the nozzle bore; and the pump chamber, the converging part, and the nozzle bore are in fluid communication, each with the other;

a diverging part having a third end with a third width and a fourth end having a fourth width, wherein:

the third width is narrower than the fourth width;

the diverging part is positioned between the converging part and the nozzle bore;

the third end is proximate the converging part;

the fourth end is proximate the nozzle bore;

the diverging part is in fluid communication with the pump chamber, the converging part, and the nozzle bore; and the converging part and the diverging part define, at least in part, a venturi; and an actuator configured to apply a pressure to a print material within the pump chamber; and a housing that encases the jetting assembly.

9. The printer of claim 8, wherein the venturi further comprises a throat positioned between, and in fluid communication with, the converging part and the diverging part.

10. The printer of claim 9, wherein radial centers of the pump chamber, the converging part, the throat, the diverging part, the nozzle bore, and the nozzle are aligned along an axis.

11. The printer of claim 9, wherein the jetting assembly block further defines a supply channel that ends in a supply port, wherein the supply channel opens into the throat of the venturi at the supply port.

12. The printer of claim 8, wherein the jetting assembly block further defines a supply channel that ends in a supply port, wherein the supply channel opens into the nozzle bore.

13. The printer of claim 8, wherein radial centers of the pump chamber, the converging part, the nozzle bore, and the nozzle are aligned along an axis.

14. The printer of claim 8, further comprising a print material within the pump chamber, the converging part, and the nozzle bore.

15. A method for printing, comprising:

firing an actuator to apply a pressure to a print material within a pump chamber;

increasing a velocity of the print material within the pump chamber responsive to the firing of the actuator;

flowing the print material from the pump chamber into first end of a converging part, through the converging part, and to a second end of the converging part responsive to the firing of the actuator, wherein the first end has a first width, the second end has a second width, and the first width is wider than the second end;

flowing the print material from the second end of the converging part to a throat; then flowing the print material from the throat to a third end of a diverging part, through the diverging part, and to a fourth end of the diverging part, wherein:

the third end of the diverging part has a third width;

the fourth end of the diverging part has a fourth width;

the third width is narrower than the fourth width; and the converging part, the throat, and the diverging part define, at least in part, a venturi;

flowing the print material from the fourth end of the diverging part into a nozzle bore, and flowing the print material from the nozzle bore to the nozzle, responsive to the firing of the actuator; and ejecting a drop of the print material from the nozzle responsive to the firing of the actuator.

16. The method of claim 15, further comprising:

increasing a velocity of the print material as the print material passes through the throat;

decreasing a pressure of the print material within the throat responsive to the increasing of the velocity; and resupplying at least a portion of a volume of the printed drop from a supply channel, through a supply port, and into the throat responsive to the decreasing of the pressure of the print material within the throat; then performing the ejecting of the drop of the print material from the nozzle after performing the resupplying.

17. The method of claim 15, further comprising:

increasing a velocity of the print material as the print material passes through the nozzle bore;

decreasing a pressure of the print material within the nozzle bore responsive to the increasing of the velocity; and resupplying at least a portion of a volume of the printed drop from a supply channel, through a supply port, and into the nozzle bore responsive to the decreasing of the pressure of the print material within the nozzle bore; then performing the ejecting of the drop of the print material from the nozzle after performing the resupplying.

18. The method of claim 15, further comprising:

decreasing a pressure at a supply inlet responsive to the flowing of the print material through the converging part and from the second end of the converging part into the nozzle bore; and flowing the print material from a supply channel through the supply inlet responsive to the decreasing of the pressure at the supply inlet, thereby replacing at least a portion of a volume of the drop of the print material, wherein the replacing of the portion of the drop volume occurs after the firing of the actuator and before the ejecting of the drop of the print material from the nozzle.

* * * * *